US005987275A

United States Patent [19]

Toyohara et al.

[11] Patent Number: 5,987,275

[45] Date of Patent: Nov. 16, 1999

[54] FIXING APPARATUS WITH POWER CONTROL BASED ON TEMPERATURE GRADIENT

[75] Inventors: Yuichiro Toyohara; Tsuyoshi Kunishi, both of Yokohama, Japan

[73] Assignee: Canon Kabushiki Kaisha, Tokyo, Japan

[21] Appl. No.: 08/796,690

[22] Filed: Mar. 4, 1997

Related U.S. Application Data

[63] Continuation of application No. 08/525,370, Sep. 7, 1995, abandoned.

[30] Foreign Application Priority Data

Sep. 9, 1994 [JP] Japan ..... 6-240822

[51] Int. Cl.[6] ..... G03G 15/20

[52] U.S. Cl. ..... 399/70; 399/33; 399/68; 219/216

[58] Field of Search ..... 399/44, 68, 69, 399/70, 335, 337, 338, 33; 219/216; 432/60; 430/124

[56] References Cited

U.S. PATENT DOCUMENTS

| | | | |
|---|---|---|---|
| 5,097,288 | 3/1992 | Akao et al. . | |
| 5,140,132 | 8/1992 | Shiokawa | 219/216 |
| 5,162,855 | 11/1992 | Nakagama et al. | 355/285 |
| 5,220,389 | 6/1993 | Kishimoto et al. | 355/285 |
| 5,241,349 | 8/1993 | Nagasaka | 355/285 |
| 5,365,314 | 11/1994 | Okuda et al. | 355/208 |
| 5,436,709 | 7/1995 | Sakaizawa et al. | 355/285 |
| 5,465,141 | 11/1995 | Asano et al. | 355/285 |
| 5,481,346 | 1/1996 | Ohzeki et al. | 355/285 |

FOREIGN PATENT DOCUMENTS

| | | |
|---|---|---|
| 63-178281 | 7/1988 | Japan . |
| 63-253977 | 10/1988 | Japan . |
| 2-181775 | 7/1990 | Japan . |
| 4-086781 | 3/1992 | Japan . |

*Primary Examiner*—Richard Moses
*Attorney, Agent, or Firm*—Fitzpatrick, Cella, Harper & Scinto

[57] ABSTRACT

The present invention provides a fixing apparatus comprising a heater generating heat by communication, a heat body to be heated by the heater, a temperature detection element for detecting an temperature of the heat body, and control means for switching warm-up control after the communication to the heater is started in accordance with a temperature change ratio of the heat body.

5 Claims, 11 Drawing Sheets

| | INPUT VOLTAGE | | | | |
|---|---|---|---|---|---|
| ROOM TEMP. | | 85V | 90V | 95V | 100V |
| | 5°C | -2 | 0 | 2 | 5 |
| | 15°C | 6 | 9 | 12 | 15 |
| | 20°C | 10 | 14 | 17 | 20 |

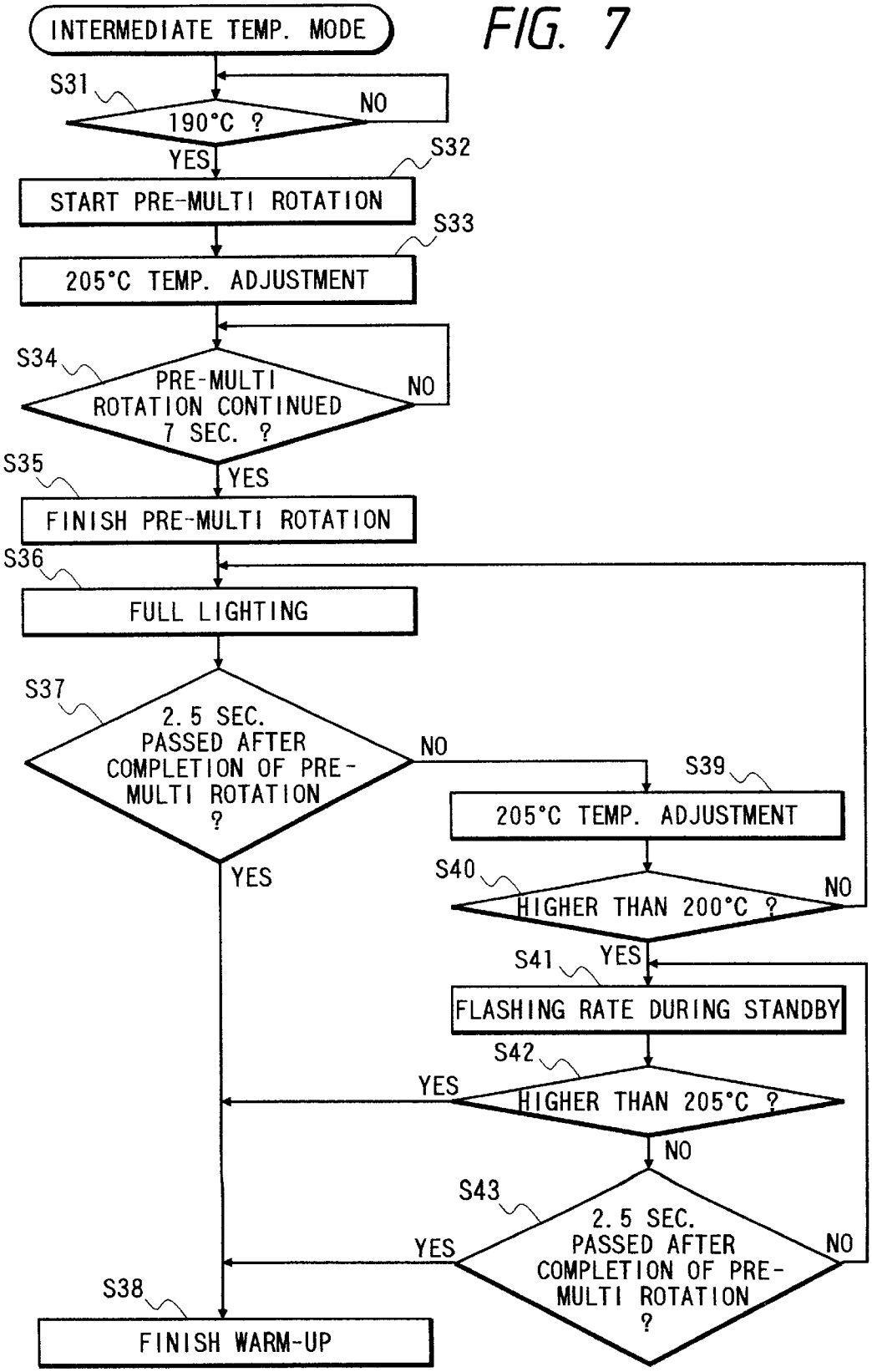
FIG. 7
INTERMEDIATE TEMP. MODE
S31
190°C ?
NO
YES
S32
START PRE-MULTI ROTATION
S33
205°C TEMP. ADJUSTMENT
S34
PRE-MULTI ROTATION CONTINUED 7 SEC. ?
NO
YES
S35
FINISH PRE-MULTI ROTATION
S36
FULL LIGHTING
S37
2.5 SEC. PASSED AFTER COMPLETION OF PRE-MULTI ROTATION ?
NO
YES
S39
205°C TEMP. ADJUSTMENT
S40
HIGHER THAN 200°C ?
NO
YES
S41
FLASHING RATE DURING STANDBY
S42
HIGHER THAN 205°C ?
YES
NO
S43
2.5 SEC. PASSED AFTER COMPLETION OF PRE-MULTI ROTATION ?
YES
NO
S38
FINISH WARM-UP

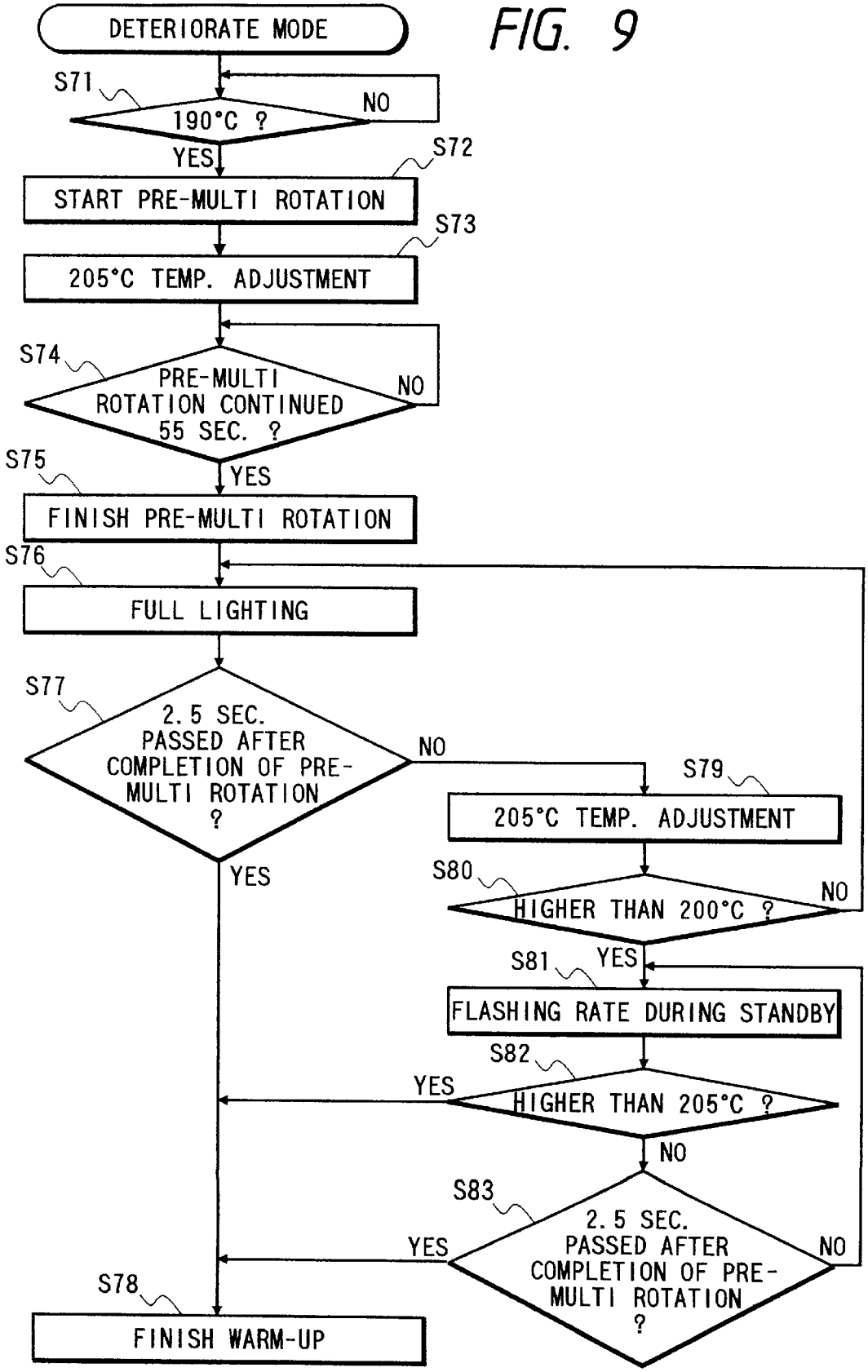
FIG. 9
DETERIORATE MODE
S71
190°C ?
NO
YES
S72
START PRE-MULTI ROTATION
S73
205°C TEMP. ADJUSTMENT
S74
PRE-MULTI ROTATION CONTINUED 55 SEC. ?
NO
YES
S75
FINISH PRE-MULTI ROTATION
S76
FULL LIGHTING
S77
2.5 SEC. PASSED AFTER COMPLETION OF PRE-MULTI ROTATION ?
NO
YES
S79
205°C TEMP. ADJUSTMENT
S80
HIGHER THAN 200°C ?
NO
YES
S81
FLASHING RATE DURING STANDBY
S82
HIGHER THAN 205°C ?
YES
NO
S83
2.5 SEC. PASSED AFTER COMPLETION OF PRE-MULTI ROTATION ?
YES
NO
S78
FINISH WARM-UP

FIXING APPARATUS WITH POWER CONTROL BASED ON TEMPERATURE GRADIENT

This application is a continuation of Application Ser. No. 08/525,350, filed Sep. 7, 1995, now abandoned.

BACKGROUND OF THE INVENTION

1. Field of the Invention

The present invention relates to a fixing apparatus used with an image forming apparatus such as a copying machine, a printer, a facsimile machine and the like.

2. Related Background Art

An example of a fixing apparatus for thermally fixing a non-fixed image to a recording material is shown in FIG. 12. As shown in FIG. 12, such a fixing apparatus comprises a heat roller (heating means) 10 including therein a heater 12 acting as a heat source, and a pressure roller (pressurizing means) 11 having a rubber surface and urged against the heat roller and serves to fuse toner on a paper sheet (recording material) 6 with heat of the surface of the heat roller 10 to fix the toner to the paper sheet 6 while pinching and conveying the paper sheet by rotation of the rollers. Accordingly, in order to perform the fixing effectively, it is necessary to maintain a surface temperature of the heat roller 10 to a predetermined temperature.

In this fixing apparatus, the surface temperature of the heat roller 10 is detected by a thermistor 13 contacted with the heat roller 10, and the detected surface temperature is compared with a control temperature previously set in a temperature control device (control means) 14. If the surface temperature is lower than the control temperature, the communication to the heater 12 is started; whereas, if the surface temperature is higher than the control temperature, the communication to the heater 12 is stopped. In this way, the surface temperature of the heat roller 10 is maintained to the predetermined temperature.

Further, in order to start an image forming operation as soon as a command signal for the image formation is inputted, the fixing apparatus is brought to a stand-by condition after the power source of the apparatus is turned ON. In the stand-by condition, the surface temperature of the heat roller 10 is maintained to a predetermined stand-by temperature.

Recently, in such a fixing apparatus, in order to reduce a warming-up time period for bringing the fixing apparatus to the stand-by condition after the power source is turned ON, a thin-walled roller having small heat capacity has been used as the heat roller, thereby shortening the warming-up time period. However, even when the heat roller 10 is heated up to the predetermined temperature, if the sufficient heat is not transmitted to the pressure roller 11 urged against the heat roller 10, the good fixing ability cannot be achieved.

To avoid this, conventionally, when the fixing apparatus is warmed up, during the warming-up, immediately after the heat roller 10 reaches a certain temperature, the heat roller 10 and the pressure roller 11 are rotated to also supply the heat to the pressure roller 11 (pre-multi rotation). In this pre-multi rotation, since the heat on the heat roller 10 is absorbed to the pressure roller 11 to temporarily decrease the temperature of the heat roller 10, the timing for starting the pre-multi rotation affects an influence upon a time period during which the heat roller 10 reaches the predetermined stand-by temperature (i.e. warming-up time period).

On the other hand, since the warming-up time period governs a heat amount accumulated in the pressure roller 11 and affects an influence upon the fixing ability, conventionally, the timing for starting the pre-multi rotation has been determined on the basis of a room temperature detected by a room temperature sensor and the like. That is to say, if the room temperature is low, since the temperature of the paper sheet 6 and the temperature of the pressure roller 11 are also low, even when the temperature of the heat roller 10 is constant, the fixing ability is inferior to the fixing ability obtained when the room temperature is high. Thus, the heat amount must be accumulated in the pressure roller 11 accordingly. Therefore, the timing for starting the pre-multi rotation is delayed until the heat roller 10 reaches the predetermined high temperature, thereby increasing the warming-up time period.

On the other hand, if the room temperature is high, since there is no need to accumulate a large heat amount in the pressure roller 11, the pre-multi rotation is started before the heat roller 10 reaches the predetermined high temperature, thereby decreasing the warming-up time period.

However, since the fixing ability of the image outputted from the fixing apparatus is influenced upon the combination of various factors such as the room temperature, input voltage, heat capacities of the heat and pressure rollers, detection temperature of the thermistor, output of the heater and the like, in the above-mentioned conventional fixing apparatus, the adequate fixing ability cannot be often achieved. For example, in accordance with the conventional warming-up time period, when the room temperature is high, if the input voltage is low, the fixing ability will be worsened.

Further, if the heat capacity of the roller is greater than the design reference value, during the same warming-up time period, the increase in temperature of the roller is delayed due to the difference in heat capacity, with the result that the fixing ability is worsened.

SUMMARY OF THE INVENTION

The present invention aims to eliminate the above-mentioned conventional drawbacks, and an object of the present invention is to provide a fixing apparatus in which good fixing ability can be obtained without effected by environmental conditions.

Another object of the present invention is to provide a fixing apparatus comprising a heater generating heat by communication, a heat body to be heated by the heater, a temperature detection element for detecting temperature of the heat body, and control means for switching warm-up control in accordance with a temperature change ratio of the heat body after the communication to the heater is started.

A further object of the present invention is to provide a fixing apparatus comprising a heater heated due to communication, a heat body heated by the heater, a temperature detection element for detecting a temperature of the heat body, control means for controlling the communication to the heater so that the temperature detected by the temperature detection element is maintained to a fixing temperature, and a timer for measuring a time period until the temperature detected by the temperature detection element reaches a predetermined temperature after the communication to the heater is started.

Wherein the control means switches the fixing temperature (luring a fixing operation on the basis of room temperature index and temperature increase gradient index obtained from a measuring time period of the timer and on the basis of a predetermined correction coefficient.

The other objects of the present invention will be apparent from the following detailed explanation of the present invention.

BRIEF DESCRIPTION OF THE DRAWINGS

FIG. 7 is a flow chart showing an intermediate temperature mode during the warm-up in the first embodiment of the present invention;

FIG. 9 is a flow chart showing a deteriorate mode during the warm-up in the first embodiment of the present invention;

DETAILED DESCRIPTION OF THE PREFERRED EMBODIMENTS

The present invention will now be explained in connection with embodiments thereof with reference to the accompanying drawings.

First Embodiment

First of all, a first embodiment of the present invention will be described with reference to FIGS. 1 to 9.

Figure 2:
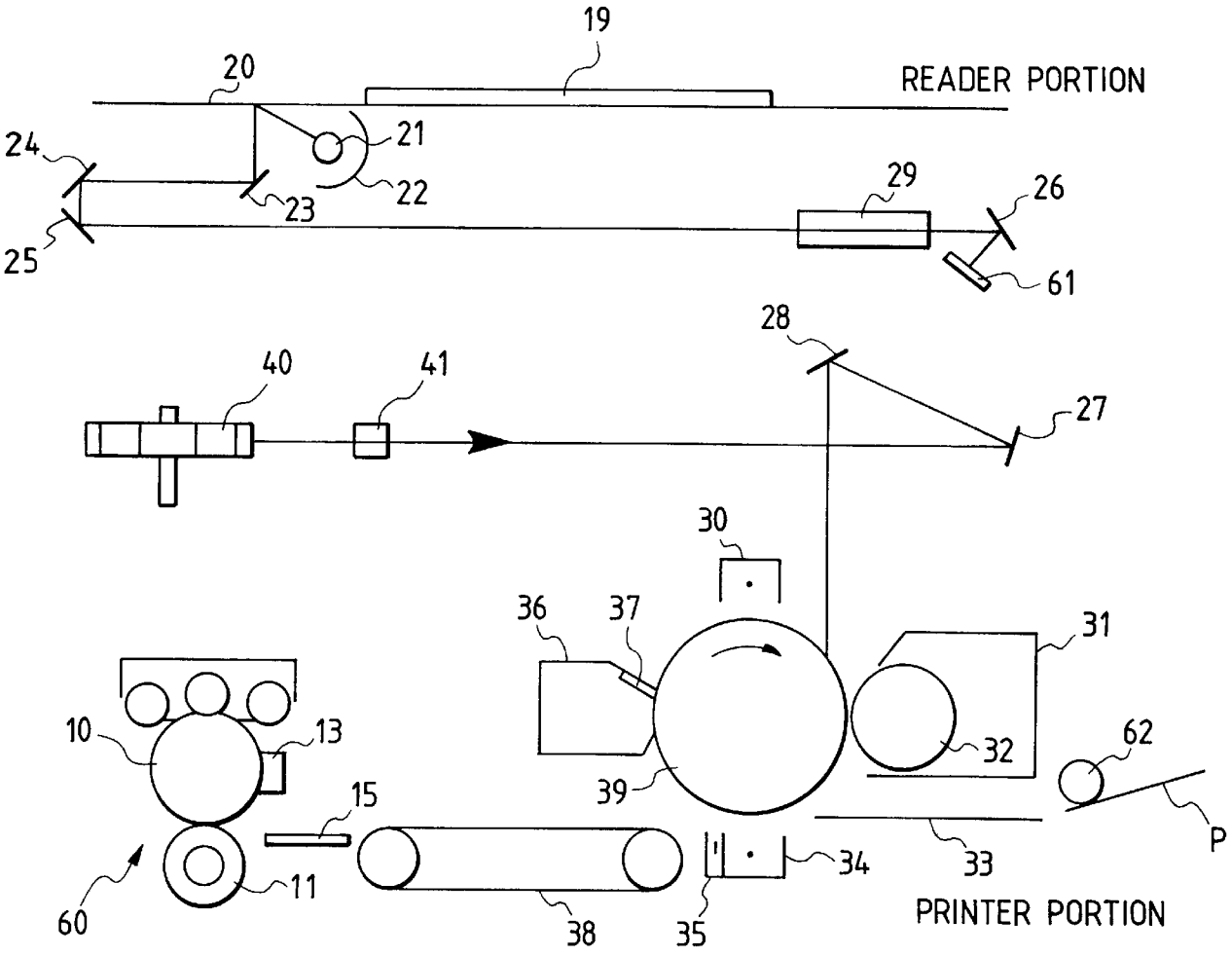
FIG. 2 is a schematic view of an image forming apparatus associated with first and second embodiments of the present invention.

As shown in FIG. 2 which is a schematic sectional view of an electrophotographic image forming apparatus of digital type using a fixing apparatus according to an embodiment of the present invention, in such an image forming apparatus, after an original 19 is rested on a fixed original support glass 20, when desired copying conditions are set and a copy start key is depressed, a photosensitive drum 39 is rotated at a predetermined speed in a clockwise direction shown by the arrow.

Further, a light source 21 (with a reflection hood 22) and a first mirror 23 are shifted at a predetermined speed V from a home position at a left side of the support glass to the right along an under surface of the support glass, and a second mirror 24 and a third mirror 25 are shifted to the right at a speed of V/2. Consequently, a lower imaged surface of the original 19 rested on the original support glass 20 is illuminated from left to right, and the left reflected from the original is focused on a CCD 61 through a focusing lens 29 and a fourth fixed mirror 26. The light incident to the CCD is converted into a digital signal by an A/D converter (not shown).

Incidentally, the image forming apparatus is a digital composite image forming machine including input paths for receiving various digital image signals to perform a plurality of functions such as a copying function, a printing function associated with a printer, a facsimile function and the like, as well as an input path for receiving the above-mentioned digital signal (read signal) from the reader portion.

The image signal converted to the digital signal is set to an image treating device (not shown) which will be described later, where the image treatment is effected. Then, the signal is set to a D/A converter, where the signal is converted into an analog signal again. On the basis of this analog signal, a semi-conductor laser is turned ON. A laser beam emitted from the semi-conductor laser is developed in a longitudinal direction through a polygon mirror 40 (which is rotated at a high speed) and an Fθ lens 41, and then is focused on the rotating photosensitive drum 39 through fixed mirrors 27, 28, thereby exposing the drum surface.

Before the exposure, the surface of the rotating photosensitive drum 39 is uniformly charged with positive or negative predetermined potential by means of a first charger 30. By exposing the charged drum surface, an electrostatic latent image corresponding to the image of the original is formed on the photosensitive drum 39. The electrostatic latent image formed on the photosensitive drum 39 is visualized by a developing roller 32 of a developing device 31 as a toner image.

On the other hand, in synchronous with the image forming operation, a transfer sheet P is supplied by a sheet supply roller 62. The supplied sheet P is guided by a guide 33 and is introduced into a transfer station between the photosensitive drum 39 and a transfer charger 34 at a predetermined timing. At the transfer station, by applying transfer corona charge, the sheet is absorbed to the photosensitive drum 39 so that the toner image on the photosensitive drum 39 is transferred onto the sheet P. Further, electricity is removed from the sheet P passed through the transfer station by means of an electricity removal probe 35, and then, the sheet is separated from the photosensitive drum 39. The separated sheet is sent, through a convey portion 38 and an inlet guide 15, to a fixing apparatus 60, where the toner image is fixed to the sheet. Thereafter, the sheet is discharged out of the image forming apparatus as a copy.

On the other hand, after the transferring, the residual toner remaining on the surface of the photosensitive drum 39 is removed by a cleaning blade 37 of a cleaning device 36 for preparation for next image formation.

When the movable optical members 21 to 25 reach their extreme positions, they are shifted in reverse directions and then are returned to their home positions for preparation for next copy cycle. Incidentally, the resolving power may be 600 dpi for input and output.

Figure 3:
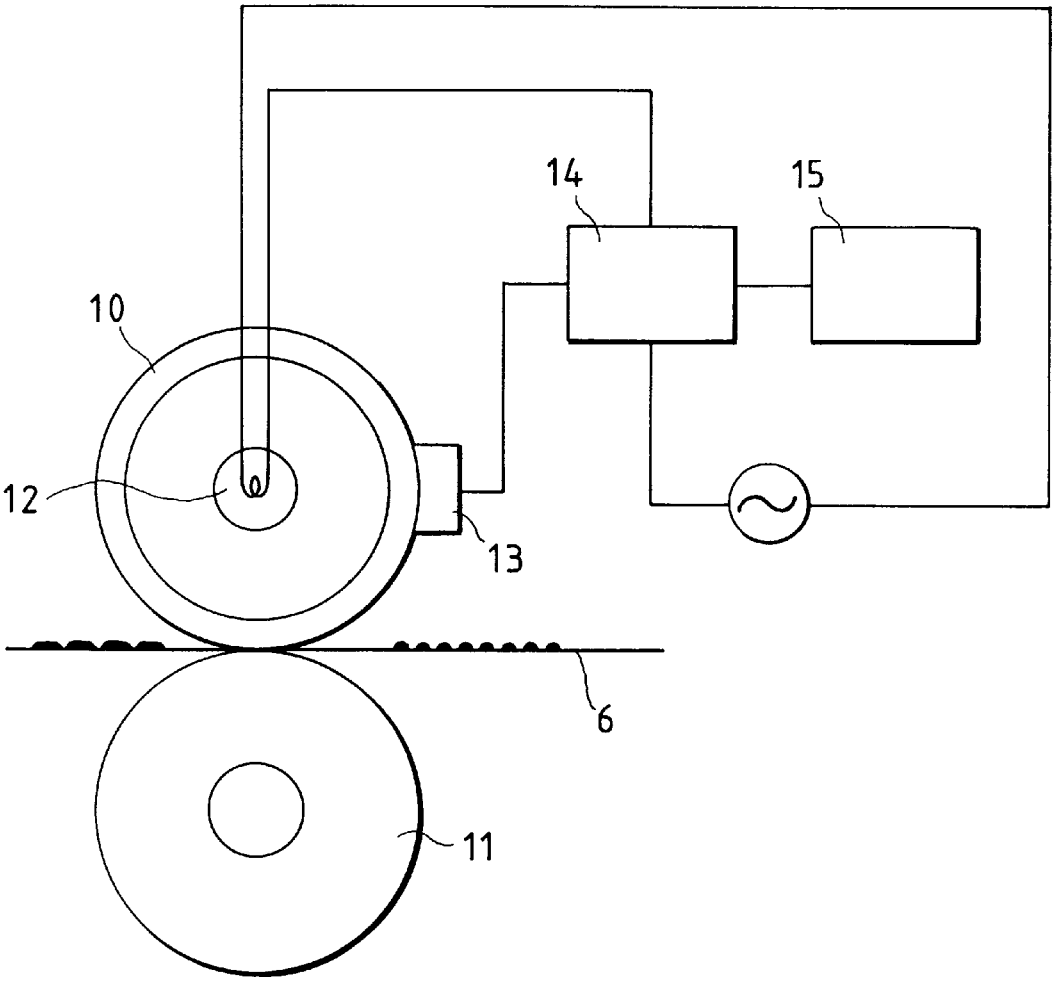
FIG. 3 is a sectional view regarding the first and second embodiments.

FIG. 3 is a sectional view of the fixing apparatus according to this embodiment. The fixing apparatus according to the illustrated embodiment comprises a heat roller (heating means) 10 including therein a heater 12 acting as a heat source, and a pressure roller (pressurizing means) 11 having a rubber surface and urged against the heat roller and serves to fuse toner on the paper sheet (transfer sheet) 6 with heat of the surface of the heat roller 10 to fix the toner to the sheet 6 while pinching and conveying the sheet by rotation of the rollers.

A surface temperature of the heat roller 10 is detected by a thermistor 13, and the fixing heater 12 is controlled by a temperature control device (control means) 14 on the basis of the detected temperature, thereby maintaining the surface temperature to a predetermined temperature. As mentioned above, the temperature control device 14 also controls a timing for starting pre-multi rotation on the basis of the detected temperature, so that a controlling method for the pre-multi rotation is changed on the basis of environmental index calculated by an environmental index calculating device 15, which will be described later.

Figure 1:
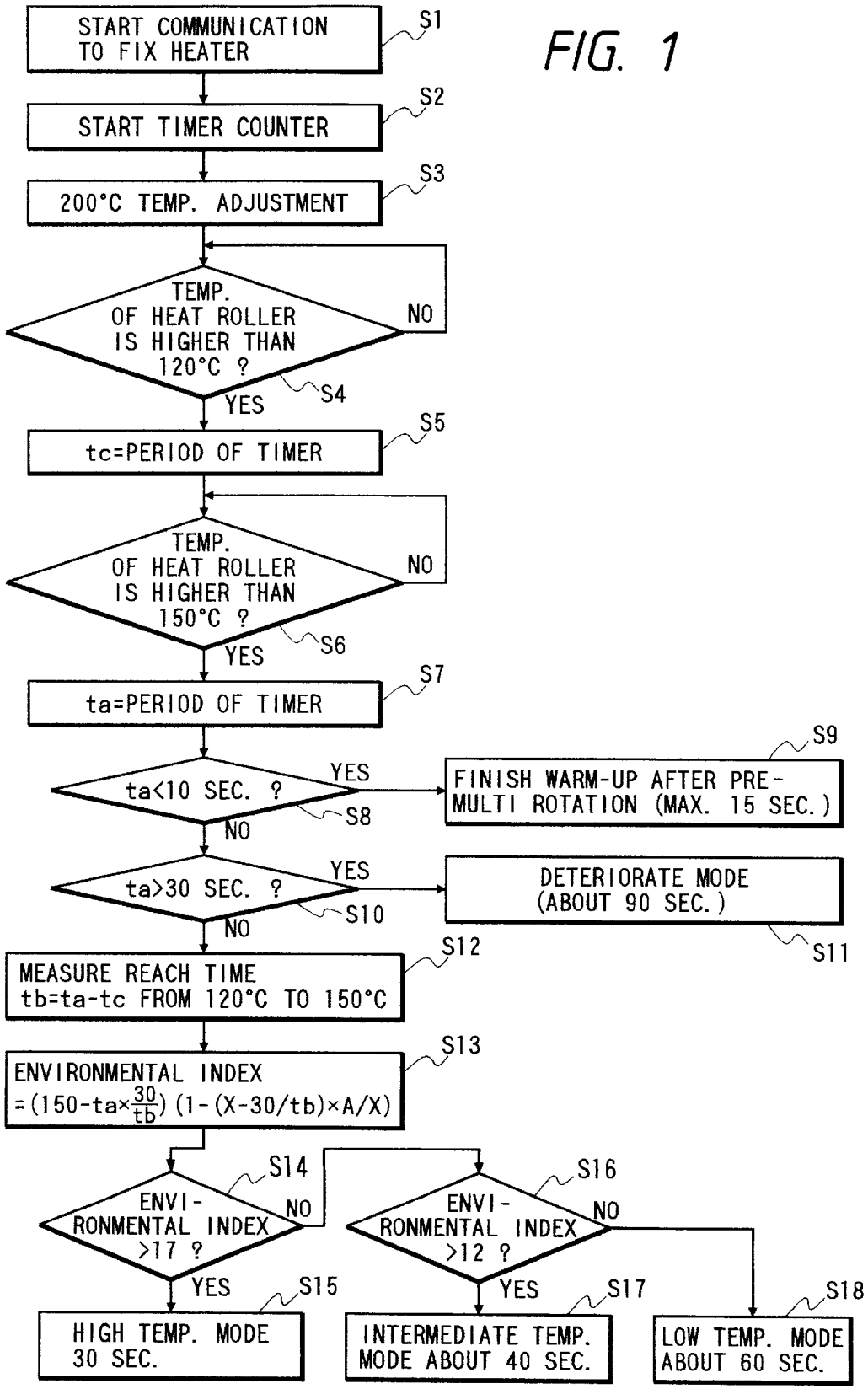
FIG. 1 is a flow chart for effecting the warm-up according to a first embodiment of the present invention.

FIG. 1 is a flow chart for controlling an environment detecting method according to this embodiment and a warm-up time on the basis of the detected environment.

First of all, when a main power source of the image forming apparatus according to the illustrated embodiment is turned ON and the communication to the fixing heater 12 is started (step S1), count of a timer is started (step S2), and a target temperature of temperature adjustment is set to 200° C. (step S3). Then, a time period $t_c$ until the temperature of the heat roller 10 shown in FIG. 2 reaches 120° C. is measured (steps S4 and S5), and a time period $t_a$ until the temperature of the heat roller 10 reaches 150° C. is measured (steps S6 and S7). Then, it is judged whether the time period $t_a$ is shorter than a certain set time period t (10 sec. in this embodiment) (step S8). If the time period $t_a$ is shorter than the time period t, it is considered that a long time period is not elapsed after the communication to the fixing apparatus is stopped, and, thus, since the pressure roller 11 is in the well warmed condition, the pre-multi rotation is started immediately and then the warm-up is finished (step S9).

On the other hand, if the time period $t_a$ is greater than 30 sec. (step S10), it is considered that the input voltage is too low and/or a room temperature is too low, and, thus, since the long warm-up time period is required, a deteriorate mode having the longest warm-up time period is started (step S11). Otherwise, a required time period $t_b$ from 120° C. to 150° C. as shown in FIG. 4 is calculated by using the time periods $t_a$, $t_c$ on the basis of an equation ($t_b=t_a-t_c$) (step S12).

The reason why the measured temperature range is set between 120° C. and 150° C. is that the temperature gradient within this range is constant and that the temperature detection sensitivity of the thermistor is excellent in the high temperature range. Ideally, although the time period is preferably measured within a wider temperature range to improve accuracy, if an arrangement wherein the temperature from the room temperature to 200° C. or more can be detected with high accuracy by the thermistor is used, the manufacturing cost of the apparatus becomes very expensive not to be of practical use. Thus, in the illustrated embodiment, the time period is measured within the temperature range between 120° C. and 150° C.

Next, room temperature index $T_r$ is calculated by using the time periods $t_a$, $t_b$ on the basis of an equation $\{T_r=150-t_a*(30/t_b)\}$. Where, the term $(30/t_b)$ represents the temperature gradient from 120° C. and 150° C. On the basis of the above equation, it is possible to guess the room temperature when the communication to the heater 12 is started.

Figures 4, 5:
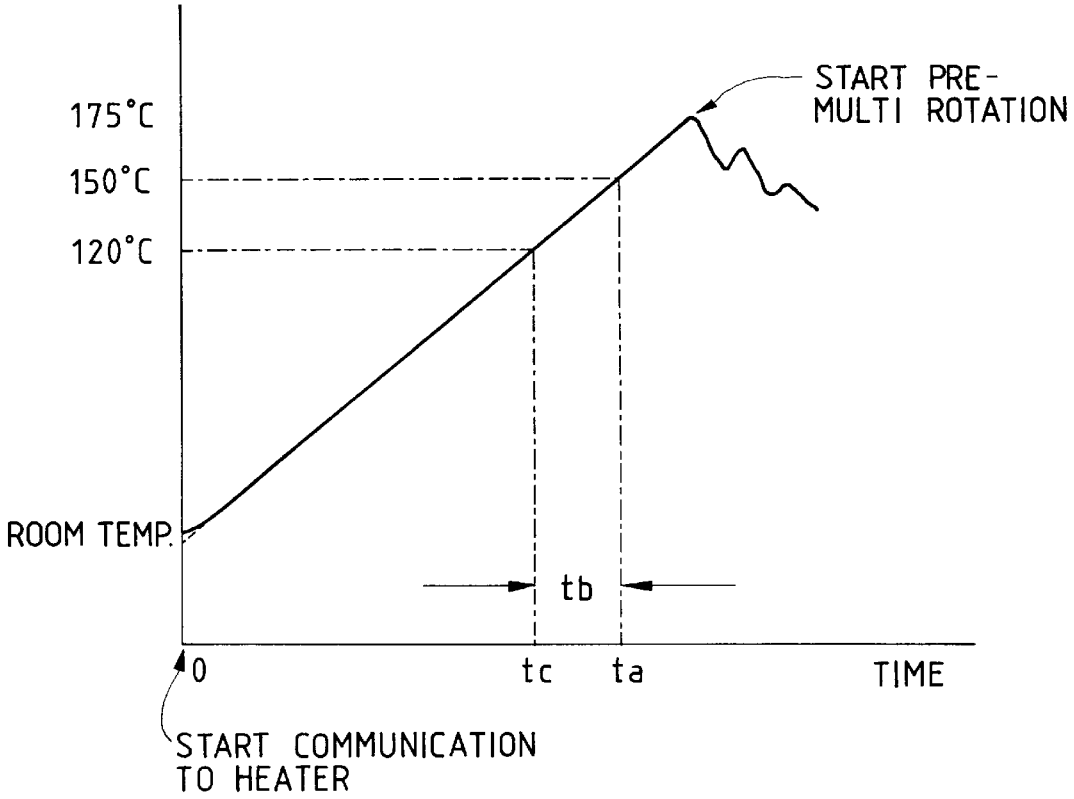
FIG. 4 is a graph showing change in temperature of a heat roller during the warm-up in the first embodiment of the present invention.
FIG. 5 is a table showing a relation between input voltage and a room temperature in the first embodiment of the present invention.

In the initial condition of the communication, as shown in FIG. 4, since a rising curve is not linear, the room temperature cannot be sought correctly by using the above linear equation. Thus, although a lower room temperature is detected, it is possible to deem the room temperature index as the room temperature.

In order to detect the environment of the entire system, regarding the calculated room temperature index, it is necessary to further consider other factors such as input voltage, heat capacities of the rollers and the like. However, in the rising curve of the surface temperature, the room temperature affects an influence only upon the time period $t_a$, but does not affect an influence upon the temperature increase gradient $(30/t_b)$. To the contrary, the input voltage, roller heat capacities and heater output affect an influence upon both the time period $t_a$ and the temperature increase gradient $(3/t_b)$. Accordingly, by performing the correction on the basis of the time period $t_b$, it is possible to reflect the influence of factors other than the room temperature. More specifically, it is assumed that the temperature increase gradient is X when all of the values of the input voltage, roller heat capacities, heater output and the like have the design reference values. In this case, the temperature increase gradient X is compared with the actual temperature increase gradient $(30/t_b)$ to obtain a difference between them. The temperature increase gradient index can be obtained by multiplying such difference by a correction coefficient A (1.5 in the illustrated embodiment) representative of reflection of influence of the input voltage and the like. That is to say, the temperature increase gradient index $T_x$ can be calculated from the following equation:

$$T_x=1-A*(X-30/t_b)/X$$

Now, the correction coefficient A will be described. The correction coefficient A is a coefficient for handling "weighting" between the room temperature and other factors affecting an influence upon the environmental index. The optimum value of the correction coefficient is changed in accordance with the heat capacity of the system and the like.

Ultimately, the environmental index is obtained by multiplying the room temperature index by the temperature increase gradient index. That is to say, environmental index$=T_r*T_x$ In the image forming apparatus according to the illustrated embodiment. In order to seek the correction A, the room temperatures were selected to 5° C., 15° C., 20° C., respectively, and the input voltage at these temperatures were varied. In these conditions, by measuring the fixing ability, respectively, the correction coefficient were determined. As a result, the optimum correction coefficient A was 1.5. A relation between the input voltage and the room temperature when the roller heat capacities, heater output and the like have their design reference values is shown in FIG. 5.

By effecting the correction on the basis of the temperature increase gradient index in this way, when the input voltage is low, the environmental index is decreased.

In the image forming apparatus according to the illustrated embodiment, immediately after the power source is turned ON, the fixing ability greatly depends upon the input voltage. If the input voltage is low, since the fixing ability is apparently poor, by using the correction coefficient of 1.5, the temperature increase gradient index is determined while reflecting the influence of the input voltage, thereby calculating the environmental index (step S13). By comparing the environmental index determined in this way with a predetermined threshold value, the warm-up mode is determined.

In the illustrated embodiment, a high temperature mode is used when the environmental index is greater than 17 (steps S14 and S15), an intermediate temperature mode is used when the environmental index is smaller than 17 and greater than 12 (steps S16 and S17), and a low temperature mode is used when the environmental index is smaller than 12 (steps S16 to S18). According to this arrangement, when the input voltage is 100 V (design reference value) and the heat capacities of the fixing roller, heater output and the like have also the design reference values, if the room temperature is higher than 17° C. the high temperature mode is used, if the room temperature is lower than 17° C. and higher than 12°

C. the intermediate temperature mode is used, and if the room temperature is lower than 12° C. the low temperature mode is used.

FIGS. 6, 7, 8 and 9 show flow charts regarding the warm-up operations in the high temperature mode, intermediate temperature mode, low temperature mode and deteriorate mode, respectively.

Figure 6:
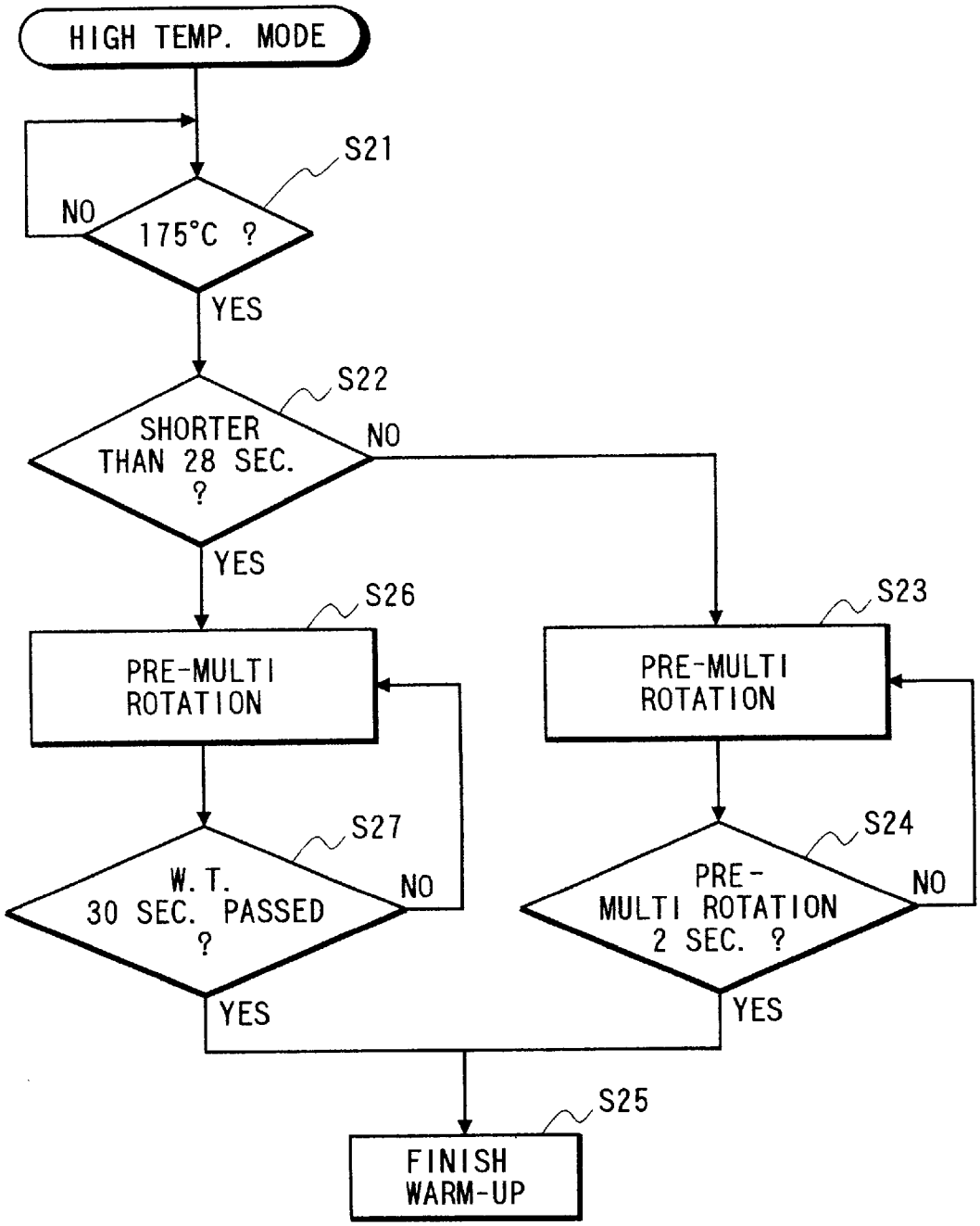
FIG. 6 is a flow chart showing a high temperature mode during the warm-up in the first embodiment of the present invention.

When the high temperature mode is started, as shown in FIG. 6, the heater 12 is fully energized until the temperature of the heat roller 10 reaches 175° C. (step S21). Then, a time period from a time when the communication to the heater 12 is started to a time when the temperature of the heat roller 10 reaches 175° C. is measured (step S22). If the time period is longer than 28 seconds, the pre-multi rotation is effected by two seconds (steps S23 and S24), and then, the warm-up is finished (step S25). On the other hand, if the time period is shorter than 28 seconds, when the temperature of the heat roller 10 reaches 175° C., the pre-multi rotation is started (step S26), and the pre-multi rotation is continued until 30 seconds is elapsed after the communication to the heater 12 is started (step S27).

When the intermediate temperature mode is started, as shown in FIG. 7, the heater 12 is fully energized until the temperature of the heat roller 10 reaches 190° C. (step S31). As soon as the temperature of the heat roller reaches 190° C., the pre-multi rotation is started (step S32). After the target temperature is set to 205° C. (step S33), the pre-multi rotation is continued for 7 seconds (step S34). After the pre-multi rotation is finished (step S35), the heater 12 is fully energized (step S36), and, it is judged whether 2.5 seconds is elapsed after the pre-multi rotation is finished (step S37).

If 2.5 seconds is elapsed, the warm-up is finished (steps S37, S38); whereas, if 2.5 seconds is not elapsed, the temperature adjustment for the target temperature of 205° C. is started (step S39), and, the full lightening of the heater is continued until 200° C. is reached (steps S40→S36→S37→S39→S40). When 200° C. is reached, the heater 12 is lightened at a predetermined flashing ratio (step S41). And, when 205° C. is reached (step S42) or when 2.5 seconds is elapsed after completion of the pre-multi rotation (step S43), the warm-up is finished (step S38).

Figure 8:
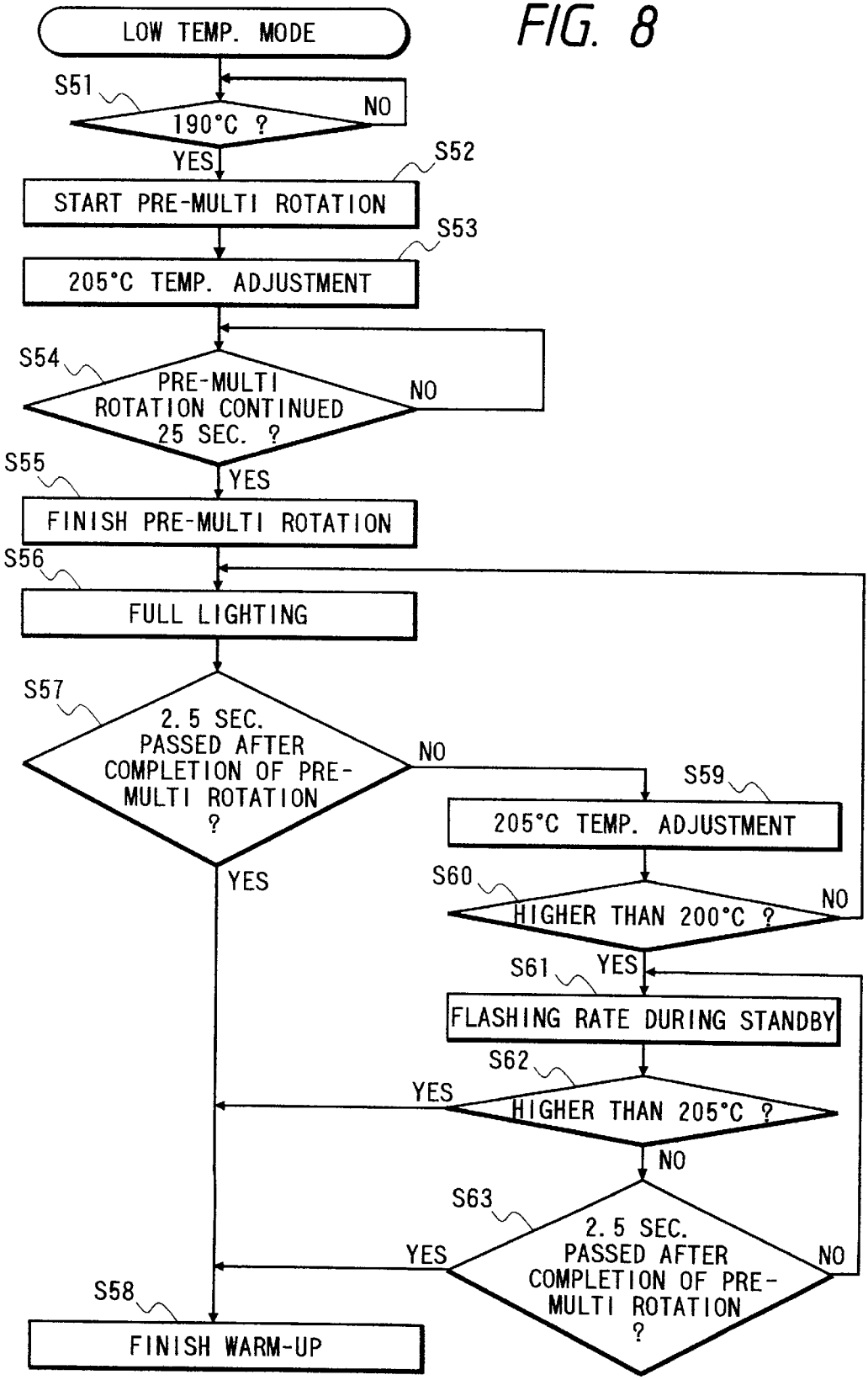
FIG. 8 is a flow chart showing a low temperature mode during the warm-up in the first embodiment of the present invention.

When the low temperature mode is started, as shown in FIG. 8, the heater 12 is fully energized until the temperature of the heat roller 10 reaches 190° C. (step S51). As soon as the temperature of the heat roller reaches 190° C., the pre-multi rotation is started (step S52). After the target temperature is set to 205° C. (step S53), the pre-multi rotation is continued for 27 seconds (step S54). After the pre-multi rotation is finished (step S55), the heater 12 is fully energized (step S56), and, it is judged whether 2.5 seconds is elapsed after the pre-multi rotation is finished (step S57).

If 2.5 seconds is elapsed, the warm-up is finished (steps S57 and S58); whereas, if 2.5 seconds is not elapsed, the temperature adjustment for the target temperature of 205° C. is started (step S59), and, the full lightening of the heater is continued until 200° C. is reached (steps S60→S56→S57→S59→S60). When 200° C. is reached, the heater 12 is lightened at a predetermined flashing ratio (step S61). And, when 205° C. is reached (step S62) or when 2.5 seconds is elapsed after completion of the pre-multi rotation (step S63), the warm-up is finished (step S58).

When the deteriorate temperature mode is started, as shown in FIG. 9, the heater 12 is fully energized until the temperature of the heat roller 10 reaches 190° C. (step S71). As soon as the temperature of the heat roller reaches 190° C., the pre-multi rotation is started (step S72). After the target temperature is set to 205° C. (step S73), the pre-multi rotation is continued for 55 seconds (step S74). After the pre-multi rotation is finished (step S75), the heater 12 is fully energized (step S76), and, it is judged whether 2.5 seconds is elapsed after the pre-multi rotation is finished (step S77).

If 2.5 seconds is elapsed, the warm-up is finished (steps S77 and S78); whereas, if 2.5 seconds is not elapsed, the temperature adjustment for the target temperature of 205° C. is started (step S79), and, the full lightening of the heater is continued until 200° C. is reaches (steps S80→S76→S77→S79→S80). When 200° C. is reached, the heater 12 is lightened at a predetermined flashing ratio (step S81). And, when 205° C. is reached (step S82) or when 2.5 seconds is elapsed after completion of the pre-multi rotation (step S83), the warm-up is finished (step S78).

In this way, since the environmental index is determined by measuring the actual temperature change in the fixing roller, it is possible to perform the control in consideration of the environmental conditions directly affecting an influence upon the fixing ability. Further, by switching the warm-up modes on the basis of the environmental index, it is possible to obtain the fixing ability which is always satisfactory. In addition, excessive long warm-up time period can be avoided.

Second Embodiment

Next, a second embodiment of the present invention will be explained with reference to FIGS. 10 and 11. Incidentally, an image forming apparatus itself according to the second embodiment is the same as that of the first embodiment.

In the second embodiment, although the environmental index is calculated in substantially the same manner as that in the first embodiment, the temperature adjustment temperature during the fixing operation is determined on the basis of the environmental index. Since the smaller the environmental index the more the fixing is difficult, it is apparent that the fixing ability is differentiated even when the fixing is effected at the same fixing temperature adjustment temperature under conditions that the environmental indexes are different from each other. Accordingly, by altering the fixing temperature adjustment temperature in accordance with the environmental index, the fixing ability can be kept constant.

For example, in a condition that the fixing apparatus is fully warmed, the factor (among factors for determining the environmental index) affecting the greatest influence upon the fixing ability is the room temperature. In the condition that the fixing apparatus is fully warmed, since the temperature of the fixing roller is kept constant by the temperature adjustment temperature, the influence of the input voltage upon the fixing ability is small in comparison with initial condition (rising condition). However, when the continuous copying operation is effected, if the input voltage is low, there is a danger of gradually worsening the fixing ability.

In this case, however, the countermeasure cannot be effected on the basis of the temperature adjustment temperature, and, thus, the wattage of the heater must be improved. That is to say, although the environmental index is determined on the basis of the room temperature index and the temperature increase gradient index, by determining the environmental index by weighing the room temperature index, it is possible to control the temperature adjustment temperature for obtaining the fixing ability which is satisfactory.

For the above reasons, in the first embodiment, the correction coefficient A for seeking the environmental index was 1.5. However, in this second embodiment, the correction coefficient is 1.2. By doing so, the room temperature is made preferential in comparison with the first embodiment, thereby providing the control suitable to the actual fixing ability. This is referred to as "environmental index 2" for discrimination from the above-mentioned environmental index used in the initial condition. By previously setting a value of the environmental index 2 and by comparing this value with a certain threshold value, the temperature adjustment temperature is determined.

Figure 10:
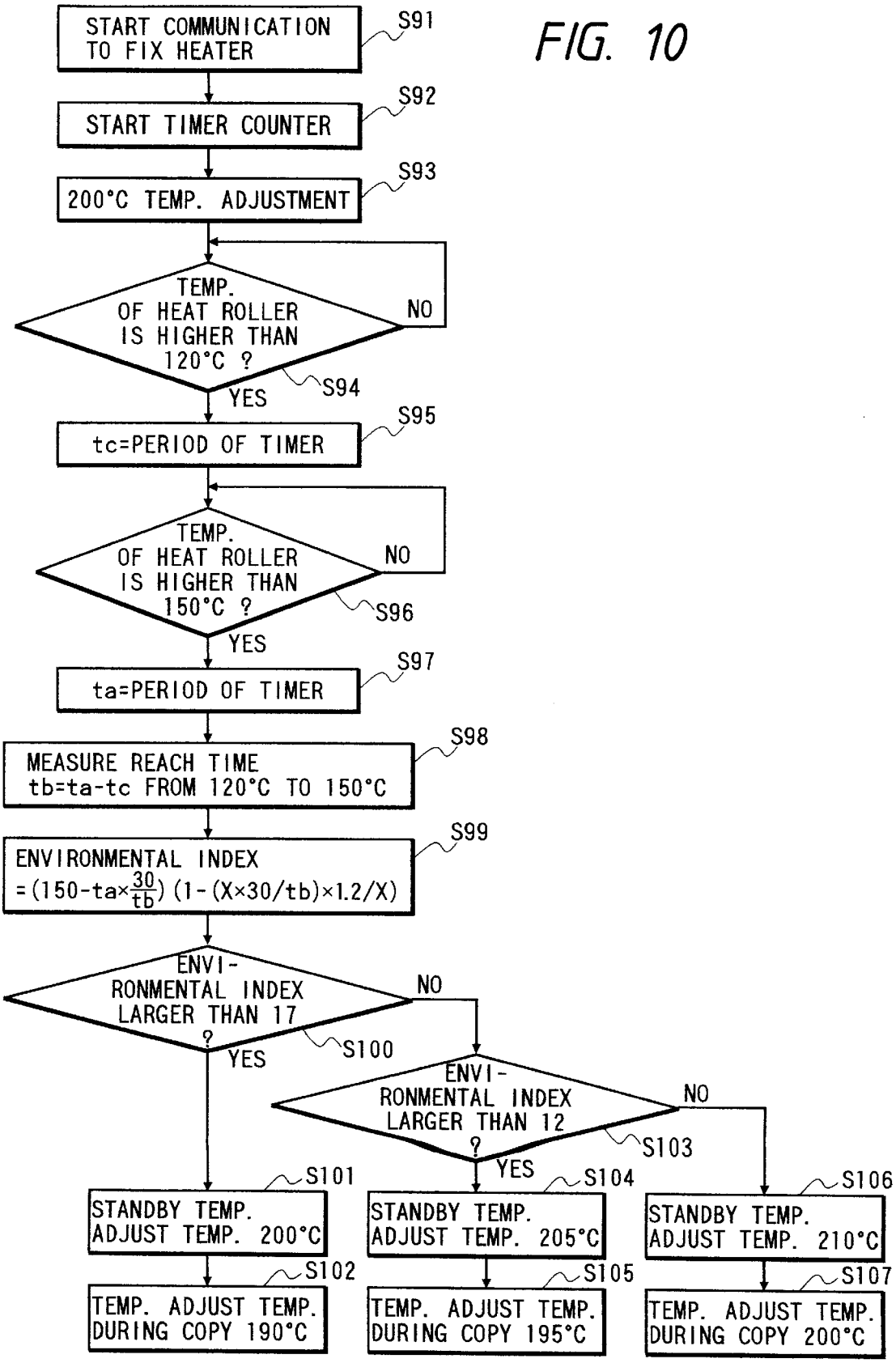
FIG. 10 is a flow chart for determining a temperature adjustment temperature in the second embodiment of the present invention.

FIG. 10 is a flow chart for determining the temperature adjustment temperature in the second embodiment.

First of all, when a main power source of the image forming apparatus is turned ON, the communication to the fixing heater 12 is started (step S91), and count of a timer is started (step S92), and a target temperature of temperature adjustment is set to 200° C. (step S93). Then, a time period $t_c$ until the output from the thermistor 13 reaches 120° C. is measured (steps S94 and S95), and a time period $t_a$ until the output reaches 150° C. is measured (steps S96 and S97). Then, a required time period $t_b$ from 120° C. to 150° C. is calculated by using the time periods $t_a$, $t_c$ on the basis of an equation ($t_b=t_a-t_c$) (step S98).

By using the time periods $t_c$, $t_b$ determined in this way, and the correction coefficient A of 1.2, the environmental index is determined from the following equations (step S99):

$$\text{room temperature index}=150-t_c*(30/t_b)$$

$$\text{temperature increase gradient index}=1-1.2*(X-30/t_b)/X$$

Then, on the basis of the environmental index determined in this way, the temperature adjustment temperature during the image formation and the stand-by temperature adjustment temperature during the stand-by condition are determined.

When the environmental index is greater than 17, since there is provided the good environment for the fixing operation, the respective temperature adjustment temperatures are set to become relatively low, and, thus, the stand-by temperature adjustment temperature is set to 200° C. and the temperature adjustment temperature during the image formation is set to 190° C. (steps S100, S101 and S102).

Further, when the environmental index is smaller than 17 and greater than 12, the temperature adjustment temperatures are slightly increased, and, thus, the stand-by temperature adjustment temperature is set to 205° C. and the temperature adjustment temperature during the image formation is set to 195° C. (steps S103, S104 and S105).

When the environmental index is smaller than 12, the temperature adjustment temperatures are further increased, and, thus, the stand-by temperature adjustment temperature is set to 210° C. and the temperature adjustment temperature during the image formation is set to 200° C. (steps S106 and S107).

The stand-by temperature adjustment temperature mainly affects an influence upon several copies in the initial condition of the image formation. In the initial condition of the image formation, the heat is absorbed to the pressure roller to swiftly decrease the temperature of the fixing roller, thus worsening the fixing ability. In particular, when the input voltage is low, since the heat amount required for initial fixing cannot be supplied sufficiently, it is desirable that the heat amount is accumulated during the stand-by as much as possible.

Figure 11:
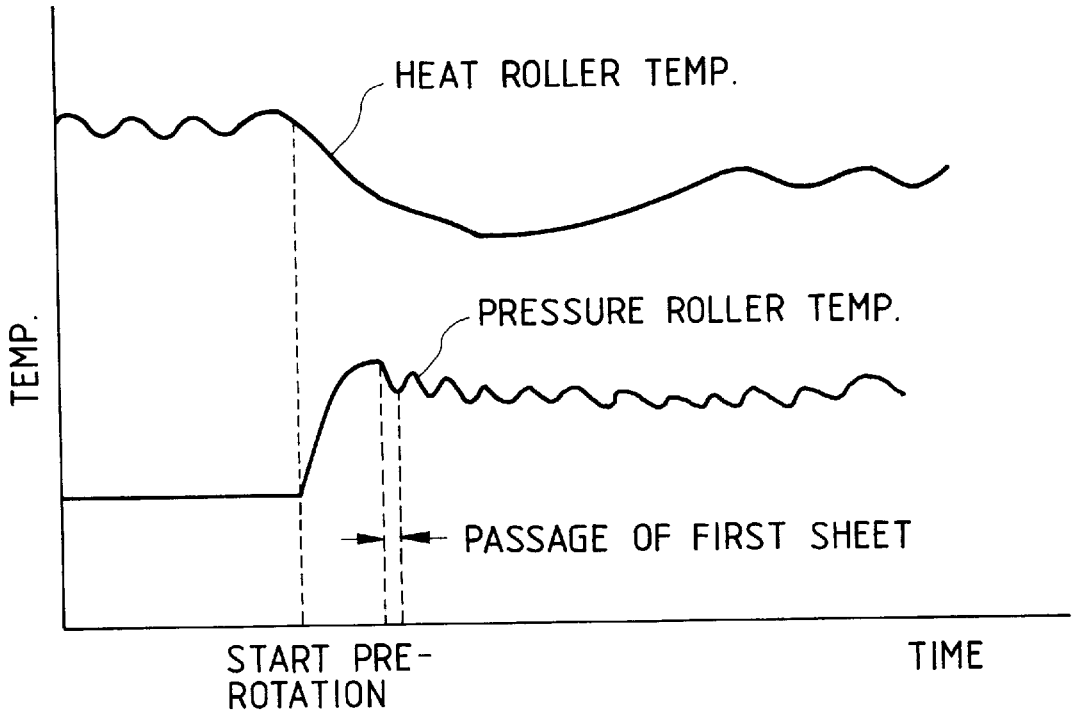
FIG. 11 is a graph showing the change in temperatures of a heat roller and a pressure roller during image formation in the second embodiment of the present invention.
Figure 12:
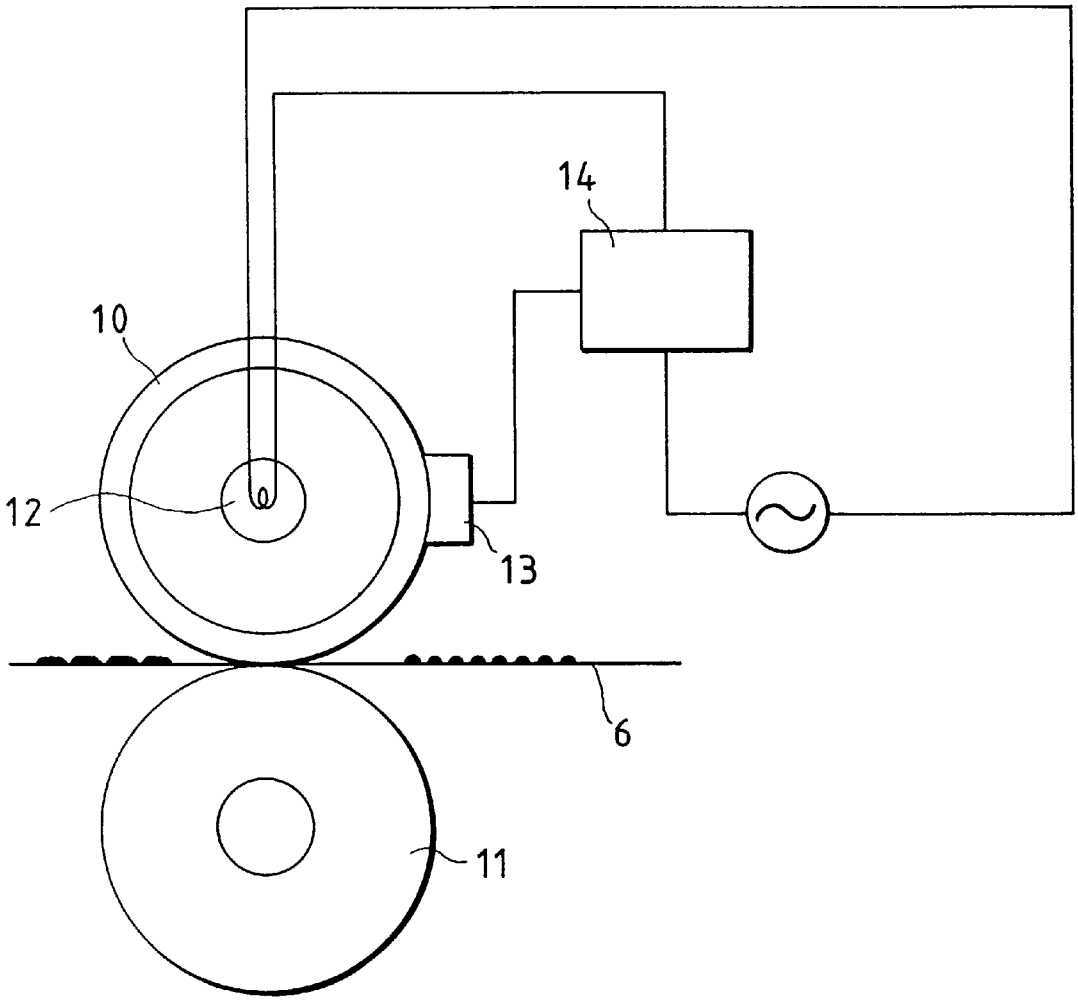
FIG. 12 is a schematic illustration showing a conventional fixing apparatus.

FIG. 11 shows the change in temperatures of the heat roller and the pressure roller when the continuous image formation is performed from the stand-by condition.

The surface temperature of the heat roller starts to decrease after the pre-multi rotation of the image forming operation is started. The heat amount corresponding to the temperature decrease of the heat roller is supplied to the pressure roller and the paper sheet. After the image forming operation is started, when several sheet is treated, the decrease in temperature of the heat roller is stopped, and the temperature of the heat roller starts to increase. The time period until the temperature of the heat roller reaches the minimum point and a temperature at the minimum point depend upon the stand-by temperature adjustment temperature. The higher the stand-by temperature adjustment temperature the higher the temperature at the minimum point. The stand-by temperature adjustment temperature is so set that the temperature at the minimum point is suppressed to provide the satisfactory fixing ability.

The temperature adjustment temperature during the image formation affects an influence upon the copies other than initial several copies during the continuous image forming operation, i.e. fixing ability after the temperature of the heat roller reaches the minimum point. If the room temperature is low, since the temperature of the paper sheet is also low, even when the heat roller has the same temperature, the fixing ability is worsened in comparison with a case where the temperature of the paper sheet is high. In consideration of the above, in this embodiment, by altering the temperature adjustment temperature during the image formation in accordance with the environmental index, in the continuous image formation, the temperature adjustment temperature is increased more than a case where the room temperature is high, so that the good fixing ability is maintained even when the temperature of the paper sheet is low.

By doing so, the adequate fixing ability can be obtained without applying excessive heat. Accordingly, there is no problem regarding the temperature increase.

Third Embodiment

Next, a third embodiment of the present invention will be explained. Incidentally, an image forming apparatus itself according to the third embodiment is the same as that of the first embodiment. Further, although the rising control method for the fixing apparatus and the control method for the temperature adjustment temperatures are the same as those in the first and second embodiments, the third embodiment has the characteristic calculation method for calculating the environmental index.

In the first and second embodiments, the environmental index was determined on the basis of the room temperature index and the temperature increase gradient index. The temperature increase gradient index serves to correct the weighing of factors affecting an influence upon the environmental index. Further, in the first and second embodiments, the temperature increase gradient was corrected by using the linear function and the correction coefficient. However, when more general consideration regarding the environmental index is applied, the correction using the linear function may be insufficient.

Thus, the temperature increase gradient index according to this embodiment is determined from the following equation:

$$T_x=1-F((X-30/t_b)/X)$$

The second term in the above equation indicates that the temperature increase gradient index TX is a function of $(X-30/t_b)/X$. When this function is the linear function, the temperature increase gradient index $T_x$ becomes as follows:

$$T_x=1-A^*(X-30/t_b)/X$$

This is the same as the first and second embodiments.

Due to the structural limitation of the image forming apparatus and for the purpose of the desired control, when the environmental index is determined, the room temperature and other factors (other than the room temperature) may be weighted by using non-linear function.

For example, the temperature increase gradient index can be determined by using the following equation:

$$T_x=1-((X-30/t_b)/X)^{1/2}$$

On the basis of the temperature increase gradient index determined in this way, the environmental index is calculated, and the rising control and the temperature adjustment temperature control are determined.

With this arrangement, any system can be treated and the freedom of control can be increased.

The present invention is not limited to the above-mentioned embodiments, but various modifications and alterations can be effected within the scope of the present invention.

What is claimed is:

1. A fixing apparatus comprising:

a heater generating heat by application of electric power to said heater;

a heat roller to be heated by said heater;

a pressure roller cooperating with said heat roller for defining a nip therebetween;

a temperature detection element for detecting a temperature of said heat roller;

electric power supply control means for controlling an electric power supply to said heater so that the temperature of said heat roller detected by said temperature detection element is maintained at a set temperature;

warm-up control means for controlling warm-up control after the electric power supply to said heater is started until said heat roller reaches the set temperature, said warm-up control means controlling rotation of said heat roller and said pressure roller in accordance with a gradient of the temperature detected by said temperature detection element.

2. A fixing apparatus according to claim 1, wherein during the warm-up control, said heat body and said pressure roller start rotations with temperatures which become lower as the temperature gradient is increased.

3. A fixing apparatus according to claim 1, wherein during the warm-up control, the greater the temperature gradient the shorter rotational time period of said heat body and said pressure roller.

4. A fixing apparatus according to claim 1, wherein the gradient of the temperature is a time in which the temperature detected by said temperature detection element reaches the predetermined temperature.

5. A fixing apparatus comprising:

a heater generating head by application of electric power to said heater;

a heat body to be heated by said heater;

a temperature detection element for detecting temperature of said heat body;

control means for controlling the electric power to said heater so that the temperature detected by said temperature detection element is maintained in a fixing temperature; and a timer for measuring a time period until the temperature detected by said temperature detection element reaches a predetermined temperature after the electric power to said heater is started;

wherein said control means changes the fixing temperature during a fixing operation on the basis of a room temperature index and a temperature increase gradient index obtained from a measuring time period of said timer and on the basis of a predetermined correction coefficient.

* * * * *

UNITED STATES PATENT AND TRADEMARK OFFICE

CERTIFICATE OF CORRECTION

PATENT NO. : 5,987,275

DATED : November 16, 1999

INVENTOR(S): YUICHIRO TOYOHARA, ET AL.

It is certified that error appears in the above-identified patent and that said Letters Patent is hereby corrected as shown below:

COVER PAGE AT ITEM [57] ABSTRACT:
Line 4, "an" should read --a--.

COLUMN 2:
Line 39, "without effected by" should read --without being effected by--.

COLUMN 4:
Line 28, "in synchronous" should read --synchronously--.

COLUMN 5:
Line 51, "$t_a*(30/t_b)\}$. Where," should read --$t_a*(30/t_b)\}$, where--;
Line 59, "deem" should read --judge--; and
Line 67, "affects" should read --exerts--.

COLUMN 6:
Line 1, "affects" should read --exerts--;
Line 3, "affects" should read --exerts--;
Line 24, "ing" should be deleted; and
Line 41, "is" should read --as--.

UNITED STATES PATENT AND TRADEMARK OFFICE

CERTIFICATE OF CORRECTION

PATENT NO. : 5,987,275

DATED : November 16, 1999

INVENTOR(S): YUICHIRO TOYOHARA, ET AL.

It is certified that error appears in the above-identified patent and that said Letters Patent is hereby corrected as shown below:

COLUMN 8:

Line 8, "lightening" should read --lighting--;
Line 9, "reaches" should read --reached--;
Line 18, "affecting" should read --exerting--; and
Line 45, "affecting" should read --exerting--.

COLUMN 9:

Line 56, "affects" should read --exerts--.

COLUMN 10:

Line 18, "affects" should read --exerts--; and
Line 51, "affecting" should read --exerting--.

Signed and Sealed this

Nineteenth Day of September, 2000

*Attest:*

Q. TODD DICKINSON

*Attesting Officer*

*Director of Patents and Trademarks*